US007050965B2

(12) United States Patent
Lopez-Estrada

(10) Patent No.: US 7,050,965 B2
(45) Date of Patent: May 23, 2006

(54) PERCEPTUAL NORMALIZATION OF DIGITAL AUDIO SIGNALS

(75) Inventor: Alex A. Lopez-Estrada, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 285 days.

(21) Appl. No.: 10/158,908

(22) Filed: Jun. 3, 2002

(65) Prior Publication Data

US 2003/0223593 A1 Dec. 4, 2003

(51) Int. Cl.
*G10L 19/00* (2006.01)

(52) U.S. Cl. ..... 704/200.1; 704/500; 704/501; 704/502; 704/503; 704/504

(58) Field of Classification Search ..... 704/200.1, 704/229, 500–504; 375/243; 381/2
See application file for complete search history.

(56) References Cited

U.S. PATENT DOCUMENTS

| | | | | |
|---|---|---|---|---|
| 5,285,498 | A * | 2/1994 | Johnston | 381/2 |
| 5,632,003 | A * | 5/1997 | Davidson et al. | 704/200.1 |
| 5,699,382 | A * | 12/1997 | Shoham et al. | 375/243 |
| 5,825,320 | A | 10/1998 | Miyamori et al. | 341/139 |
| 5,845,243 | A * | 12/1998 | Smart et al. | 704/200.1 |
| 5,978,762 | A * | 11/1999 | Smyth et al. | 704/229 |
| 6,128,593 | A | 10/2000 | Hu | |

OTHER PUBLICATIONS

Pao-Chi Chang et al.: *Scalable embedded zero tree wavelet packet audio coding*, 2001 IEEE Third Workshop on Signal Processing Advances in Wireless Communications (SPAWC'01). Workshop Proceedings (Cat. No. 01EX471), Proceedings of SPAWC-2001. Third IEEE Signal Processing Workshop on Signal Processing Advances in Wireless Communic. pp. 384-387, XP010542353 2001, Piscataway, NJ, USA, IEEE, USA ISBN: 0-7803=6720-0.

Reyes N R et al.: *A new perceptual entropy-based method to achieve a signal adapted wavelet tree in a low bit rate perceptual audio coder*, Signal Processing X Theories and Applications. Proceedings of EUSIPCO 2000. Tenth European Signal Processing Conference, Proceedings of 10th European Signal Processing Conference, Tampere, Finland, Sep. 4-8, 2000, pp. 2057-2060, vol. 4, XP0080819 2000, Tampere, Finland, Tampere Univ. Technology, Finland ISBN: 952-15-0443-9.

Tsoukalas D E, et al.: *Speech Enhancement Based on Audible Noise Suppression*, IEEE Transactions on Speech and Audio Processing, IEEE Inc., New York, US, vol. 5, No. 6, Nov. 1, 1997, pp. 497-513, XP000785344 ISSN: 1063-6676.

* cited by examiner

*Primary Examiner*—Richemond Dorvil
*Assistant Examiner*—Qi Han
(74) *Attorney, Agent, or Firm*—Alan L. Pedersen-Giles

(57) ABSTRACT

A method of normalizing received digital audio data includes decomposing the digital audio data into a plurality of sub-bands and applying a psycho-acoustic model to the digital audio data to generate a plurality of masking thresholds. The method further includes generating a plurality of transformation adjustment parameters based on the masking thresholds and desired transformation parameters and applying the transformation adjustment parameters to the sub-bands to generate transformed sub-bands.

18 Claims, 5 Drawing Sheets

PERCEPTUAL NORMALIZATION OF DIGITAL AUDIO SIGNALS

FIELD OF THE INVENTION

One embodiment of the present invention is directed to digital audio signals. More particularly, one embodiment of the present invention is directed to the perceptual normalization of digital audio signals.

BACKGROUND INFORMATION

Digital audio signals are frequently normalized to account for changes in conditions or user preferences. Examples of normalizing digital audio signals include changing the volume of the signals or changing the dynamic range of the signals. An example of when the dynamic range may be required to be changed is when 24-bit coded digital signals must be converted to 16-bit coded digital signals to accommodate a 16-bit playback device.

Normalization of digital audio signals is often performed blindly on the digital audio source without care for its contents. In most instances, blind audio adjustment results in perceptually noticeable artifacts, due to the fact that all components of the signal are equally altered. One method of digital audio normalization consists of compressing or extending the dynamic range of the digital signal by applying functional transforms to the input audio signal. These transforms can be linear or non-linear in nature. However, the most common methods use a point-to-point linear transformation of the input audio.

FIG. 1 is a graph that illustrates an example where a linear transformation is applied to a normal distribution of digital audio samples. This method does not take into account noise buried within the signal. By applying a function that increases the signal mean and spread, additive noise buried in the signal will also be amplified. For example, if the distribution presented in FIG. 1 corresponds to some error or noise distribution, applying a simple linear transformation will result in a higher mean error accompanied with a wider spread as shown by comparing curve 12 (the input signal) with curve 11 (the normalized signal). That is typically a bad situation in most audio applications.

Based on the foregoing, there is a need for an improved normalization technique for digital audio signals that reduces or eliminates perceptually noticeable artifacts.

DETAILED DESCRIPTION

One embodiment of the present invention is a method of normalizing digital audio data by analyzing the data to selectively alter the properties of the audio components based on the characteristics of the auditory system. In one embodiment, the method includes decomposing the audio data into sub-bands as well as applying a psycho-acoustic model to the data. As a result, the introduction of perceptually noticeable artifacts is prevented.

One embodiment of the present invention utilizes perceptual models and "critical bands". The auditory system is often modeled as a filter bank that decomposes the audio signal into bands called critical bands. A critical band consists of one or more audio frequency components that are treated as a single entity. Some audio frequency components can mask other components within a critical band (intra-masking) and components from other critical bands (inter-masking). Although the human auditory system is highly complex, computational models have been successfully used in many applications.

Figure 1:
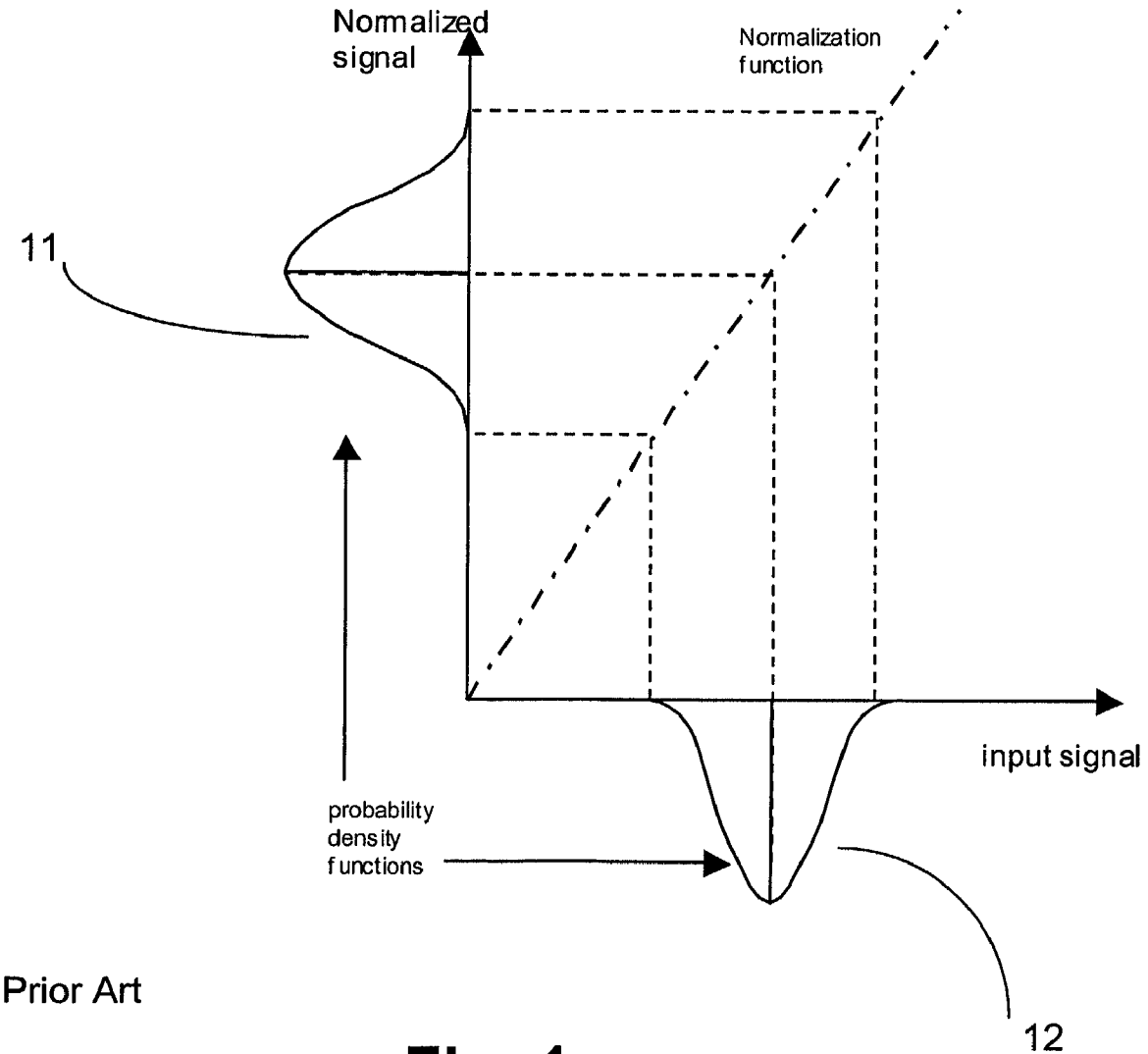
Fig. 1 Prior Art
FIG. 1 is a graph that illustrates an example where a linear transformation is applied to a normal distribution of digital audio samples.

A perceptual model or Psycho-Acoustic Model ("PAM") computes a threshold mask, usually in terms of Sound Pressure Level ("SPL"), as a function of critical bands. Any audio component falling below the threshold skirt will be "masked" and therefore will not be audible. Lossy bit rate reduction or audio coding algorithms take advantage of this phenomenon to hide quantization errors below this threshold. Hence, care should be taken in trying not to uncover these errors. Straightforward linear transformations as illustrated above in conjunction with FIG. 1 will potentially amplify these errors, making them audible to the user. In addition, quantization noise from the A/D conversion could become uncovered by a dynamic range expansion procedure. On the other hand, audible signals above the threshold could be masked if straightforward dynamic range compression occurs.

Figure 2:
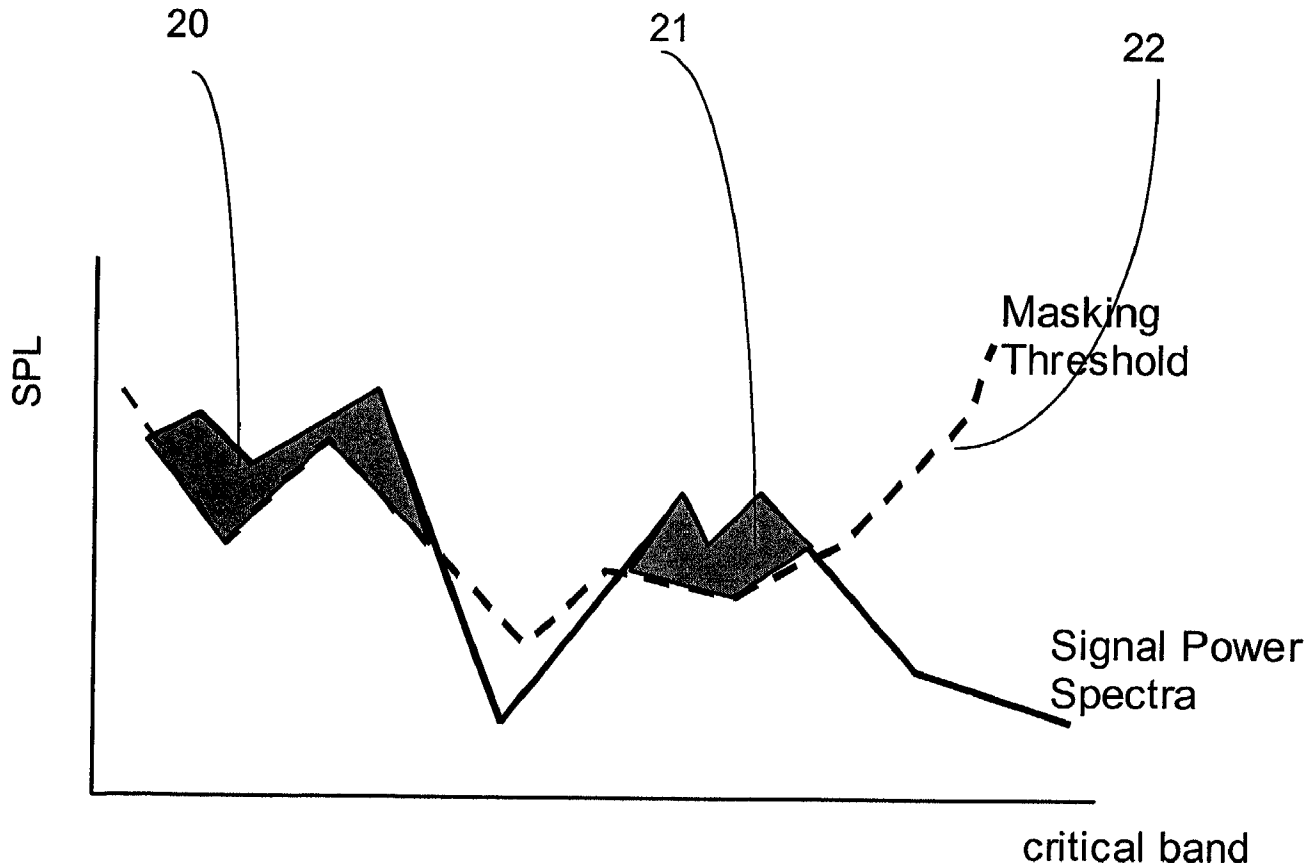
FIG. 2 is a graph that illustrates a hypothetical example of masking a signal spectrum.

FIG. 2 is a graph that illustrates a hypothetical example of masking a signal spectrum. Shaded regions 20 and 21 are audible to an average listener. Anything falling under the mask 22 will be inaudible.

Figure 3:
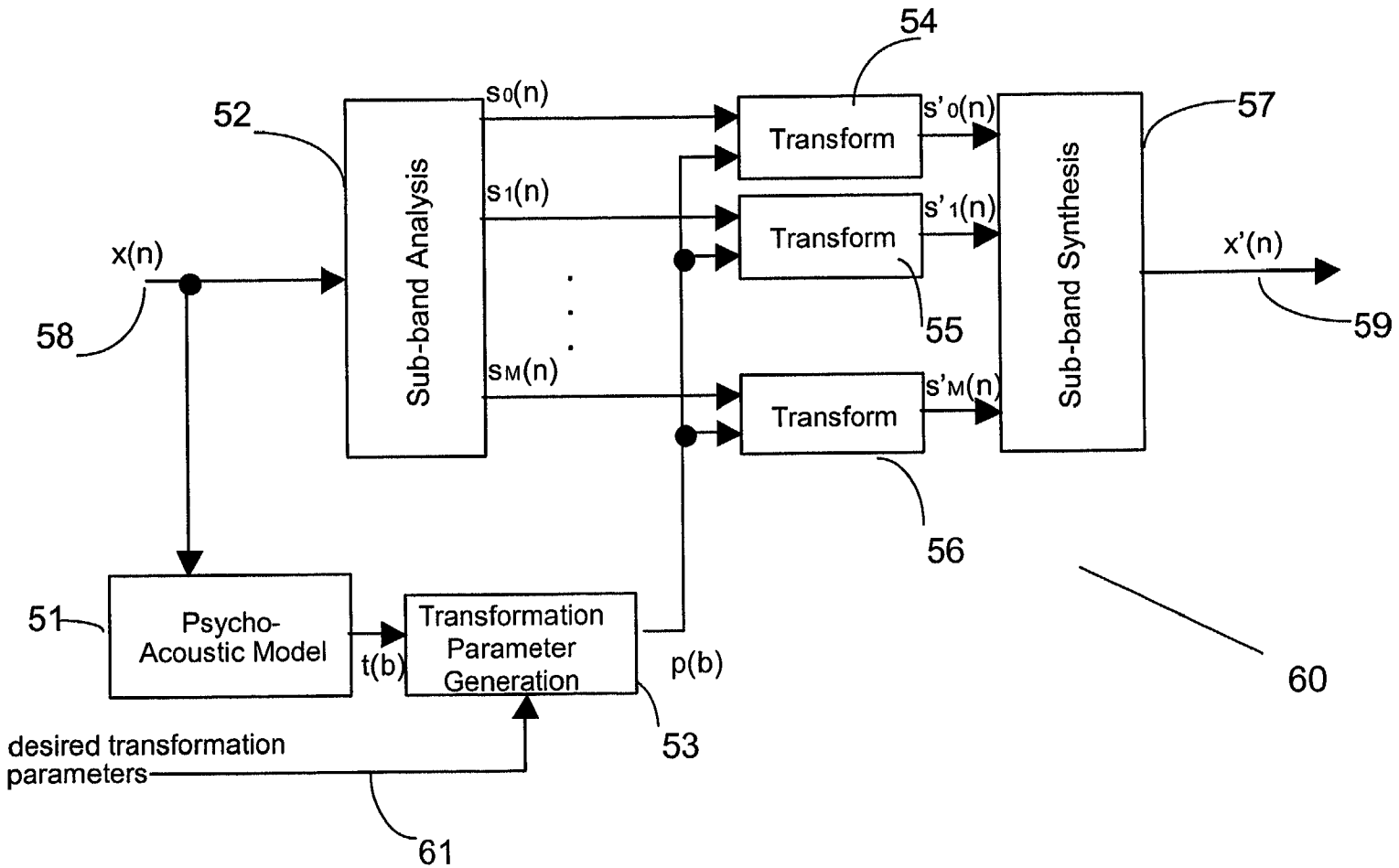
FIG. 3 is a block diagram of functional blocks of a normalizer in accordance with one embodiment of the present invention.

FIG. 3 is a block diagram of functional blocks of a normalizer 60 in accordance with one embodiment of the present invention. The functionality of the blocks of FIG. 3 can be performed by hardware components, by software instructions that are executed by a processor, or by any combination of hardware or software.

The incoming digital audio signals are received at input 58. In one embodiment, the digital audio signals are in the form of input audio blocks of N length, $x(n)$ $n=0, 1, \ldots, N-1$. In another embodiment, an entire file of digital audio signals may be processed by normalizer 60.

The digital audio signals are received from input 58 at a sub-band analysis module 52. In one embodiment, sub-band analysis module 52 decomposes the input audio blocks of N length, $x(n)$ $n=0, 1, \ldots, N-1$, into M sub-bands, $s_b(n)$ $b=0, 1, \ldots, M-1$, $n=0, 1, \ldots, N/M-1$, where each sub-band is associated with a critical band. In another embodiment, the sub-bands are not associated with any critical bands.

Figure 4:
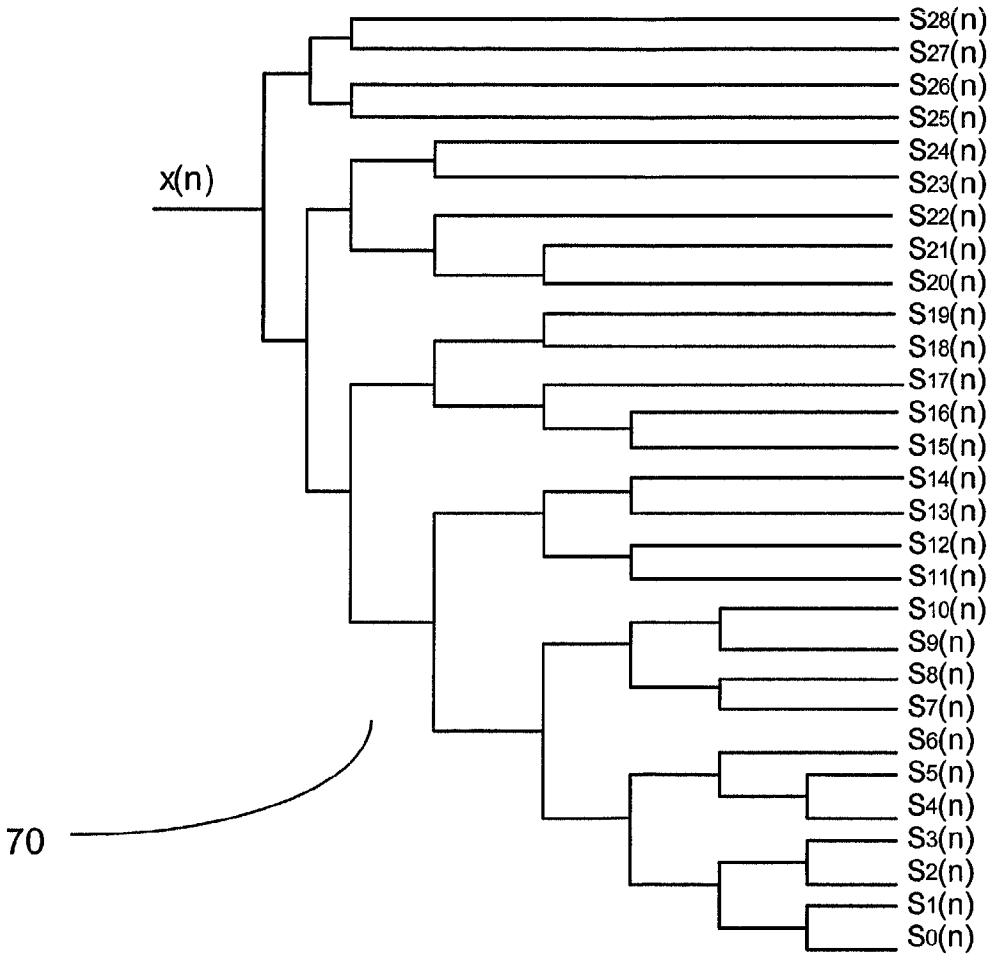
FIG. 4 is a diagram that illustrates one embodiment of a Wavelet Packet Tree structure.

In one embodiment, sub-band analysis module 52 utilizes a sub-band analysis scheme based on a Wavelet Packet Tree. FIG. 4 is a diagram that illustrates one specific embodiment of a Wavelet Packet Tree structure that consists of 29 output sub-bands assuming input audio sampled at 44.1 KHz. The tree structure shown in FIG. 4 varies depending on the sampling rate. Each line represents decimation by 2 (low-pass filter followed by sub-sampling by a factor of 2).

Embodiments of a low pass wavelet filter to be used during sub-band analysis can be varied as an optimization parameter, which is dependent on tradeoffs between perceived audio quality and computing performance. One embodiment utilizes Daubechies filters with N=2 (commonly known as the db2 filter), whose normalized coefficients are given by the following sequence, c[n]:

$$c[n]=\left\{\frac{1+\sqrt{3}}{4\sqrt{2}},\frac{3+\sqrt{3}}{4\sqrt{2}},\frac{3-\sqrt{3}}{4\sqrt{2}},\frac{1-\sqrt{3}}{4\sqrt{2}}\right\}$$

Each sub-band attempts to be co-centered with the human auditory system critical bands. Therefore, a fair straightforward association between the output of a psycho-acoustic model module 51 and sub-band analysis module 52 can be made.

Psycho-acoustic model module 51 also receives the digital audio signals from input 58. A psycho-acoustic model ("PAM") utilizes an algorithm to model the human auditory system. Many different PAM algorithms are known and can be used with embodiments of the present invention. However, the theoretical basis is the same for most of the algorithms:

- Decompose audio signal into a frequency spectrum domain—Fast Fourier Transforms ("FFT") being the most widely used tool.
- Group spectral bands into critical bands. This is a mapping from FFT samples to M critical bands.
- Determination of tonal and non-tonal (noise-like components) within the critical bands.
- Calculation of the individual masking thresholds for each of the critical band components by using the energy levels, tonality and frequency positions.
- Calculation of some type of masking threshold as a function of the critical bands.

One embodiment of PAM module 51 uses the absolute threshold of hearing (or threshold in quiet) to avoid high computational complexity associated with more sophisticated models. The minimum threshold of hearing is given in terms of the Sound Pressure Level (or the log of the Power Spectrum) by the following equation:

$$T(SPL)=3.64f^{-0.8}-6.5e^{[-0.6(f-33)^2]}+0.001f^4 \quad (1)$$

where f is given in kilohertz.

A mapping from frequency in kilohertz into critical bands (or bark rate) is accomplished by the following equations:

$$f_b=13\arctan(0.76f)+3.5\arctan(f/7.5)^2 \quad (2)$$

$$BW(\mathrm{Hz})=15+75[1+1.4f^2] \quad (3)$$

where BW is the bandwidth of the critical band. Starting at frequency line 0 and creating critical bands so that the upper edge of one band is the lower edge of the next band, the values of the absolute threshold of hearing in equation (1) can be accumulated so that:

$$T(b)=\frac{1}{N_b}\sum_{\omega=\omega_l}^{\omega_h}10^{\frac{T(SPL)}{10}} \quad (4)$$

where $N_b$ is the number of frequency lines within the critical band, $\omega_l$ and $\omega_h$ are the lower and upper bounds for critical band b.

In this embodiment, a real valued FFT of the input audio is computed on overlapping blocks of N input samples; N/2 frequency lines are retained, due to the symmetry properties of the FFT of real valued signals. The Power Spectrum of the input audio is then computed as:

$$P(\omega)=Re(\omega)^2+Im(\omega)^2 \quad (5)$$

The power spectrum of the signal and the masking thresholds (threshold in quiet in this case) are then passed to the next module. The output of PAM module 51 is input to a transformation parameter generation module 53. Transformation parameter generation module 53 receives as an input desired transformation parameters at input 61 that are based on the desired normalization or transformation. In one embodiment, transformation parameter generation module 53 generates dynamic range adjustment parameters, p(b) b=0, 1, . . . , M−1, as a function of critical band according to the masking thresholds and the desired transformation.

In one embodiment, transformation parameter generation module 53 first attempts to provide a quantitative measure of the more dominating critical bands in terms of their volume and masking properties. This qualitative measure is referred to as "Sub-band Dominancy Metric" ("SDM"). Therefore, the dynamic range normalization parameters are "massaged" in order to be less aggressive in the transformation of non-dominant bands that may hide noise or quantization errors.

The SDM is computed as the sum of the absolute differences between the frequency line and the associated masking threshold within a specific critical band:

$$SDM(b)=\mathrm{MAX}[P(\omega)-T(b)]\omega=\omega_l\rightarrow\omega_h \quad (6)$$

where $\omega_l$ and $\omega_h$ correspond to the lower and upper frequency bounds of critical band b.

Therefore, critical bands whose P(ω) is significantly larger than the masking threshold are considered to be dominant and their SDM will approach infinity, while critical bands whose P(ω) fall below the masking threshold are non-dominant and their SDM will approach negative infinity.

To bind the SDM metric to the range from 0.0 to 1.0, the following equation can be used:

$$SDM'(b)=\frac{1}{\pi}a\tan(SDM(b)/\gamma-\delta)+\frac{1}{2} \quad (7)$$

where the parameters γ and δ are optimized depending on the application, e.g. γ=32, δ=2.

Transformation parameter generation module 53, in addition to generating the SDM metrics, also modifies desired input transformation parameters 61. In one embodiment, it will be assumed that a linear transformation of the form:

$$x'(n)=\alpha x(n)+\beta \quad (8)$$

will be carried out on the input signal data. The parameters α and β are either provided by the user/application or automatically computed from the audio signal statistics.

As an example of operation of transformation parameter generation module 53, assume it is desired to normalize the dynamic range of a 16 bit audio signal whose values range from −32768 to 32767. In one embodiment, all audio processed is to be normalized to a range specified by [ref_min, ref_max]. In one example, ref_min=−20000 and ref_max=20000. An automatic method to derive the transformation parameters could be:

- Compute the max and min signal value in the initial block of samples.

Determine the parameters α and β, so that the new max and min values of the transformed block are normalized to [−20000, 20000]. This can be solved using elementary algebra by determining the slope and intercept of the line:

$$\alpha = \frac{[\text{ref_max} - \text{ref_min}]}{\max - \min} = \frac{[20000 - (-20000)]}{\max - \min} \tag{9}$$

$$\beta = \text{ref_max} - \alpha \cdot \max = 20000 - \alpha \cdot \max$$

Repeat for each incoming block iteratively, while keeping the max and min history of previous blocks.

Once normalization parameters are determined, they are adjusted according to the SDM. For each sub-band:

$$\alpha'(b) = (\alpha - 1) \cdot SDM'(b) + 1 \tag{10}$$

$$\beta'(b) = \beta \cdot SDM'(b)$$

Therefore, if SDM for a specific sub-band is equal to 0, as for non-dominant sub-bands, the slope is equal to 1.0 and the intercept is equal to 0. This results in an unchanged sub-band. If SDM is equal 1.0, as for dominant sub-bands, the slope and intercepts will be equal to the original values obtained from equation (9). The parameters p(b) that are to be passed along to sub-band transform modules 54–56 of normalizer 60 are α'(b) and β'(b) for this embodiment.

The outputs from sub-band analysis module 52 and transformation parameter generation module 53 are input to sub-band transform modules 54–56. Sub-band transform modules 54–56 apply the transformation parameters received from transformation parameter generation module 53 to each of the sub-bands received from sub-band analysis module 52. The sub-band transformation is expressed by the following equation (in the embodiment of the linear transformation as presented in Equation (8)):

$$s'_b(n) = \alpha'(b) s_b(n) + \beta'(b) \quad b = 0, 1, \ldots, M-1;\ n = 0, 1, \ldots, N/M-1 \tag{11}$$

In one embodiment, the outputs of sub-band transform modules 54–56 are the final output of normalizer 60. In this embodiment, the data may be later fed into an encoder, or can be analyzed.

In another embodiment, the outputs of sub-band transform modules 54–56 are received by a sub-band synthesis module 57 which synthesizes the transformed sub-bands, $s'_b(n)$ b=0, 1, . . . , M−1, n=0, 1, . . . , N/M−1, to form an output normalized signal, x'(n) at output 59. In one embodiment, sub-band synthesis by sub-band synthesis module 57 is accomplished by inverting the Wavelet Tree structure shown in FIG. 4 and using the synthesis filters instead. In one embodiment the synthesis filters are the Daubechies wavelet filters with N=2 (commonly known as db2), whose normalized coefficients are given by the following sequence, d[n]:

$$d[n] = \left\{ \frac{1-\sqrt{3}}{4\sqrt{2}}, \frac{-3+\sqrt{3}}{4\sqrt{2}}, \frac{3+\sqrt{3}}{4\sqrt{2}}, \frac{-1-\sqrt{3}}{4\sqrt{2}} \right\}$$

Therefore each decimation operation is substituted with an interpolation operation (up-sample and high pass filter) using the complementary wavelet filters.

Figure 5:
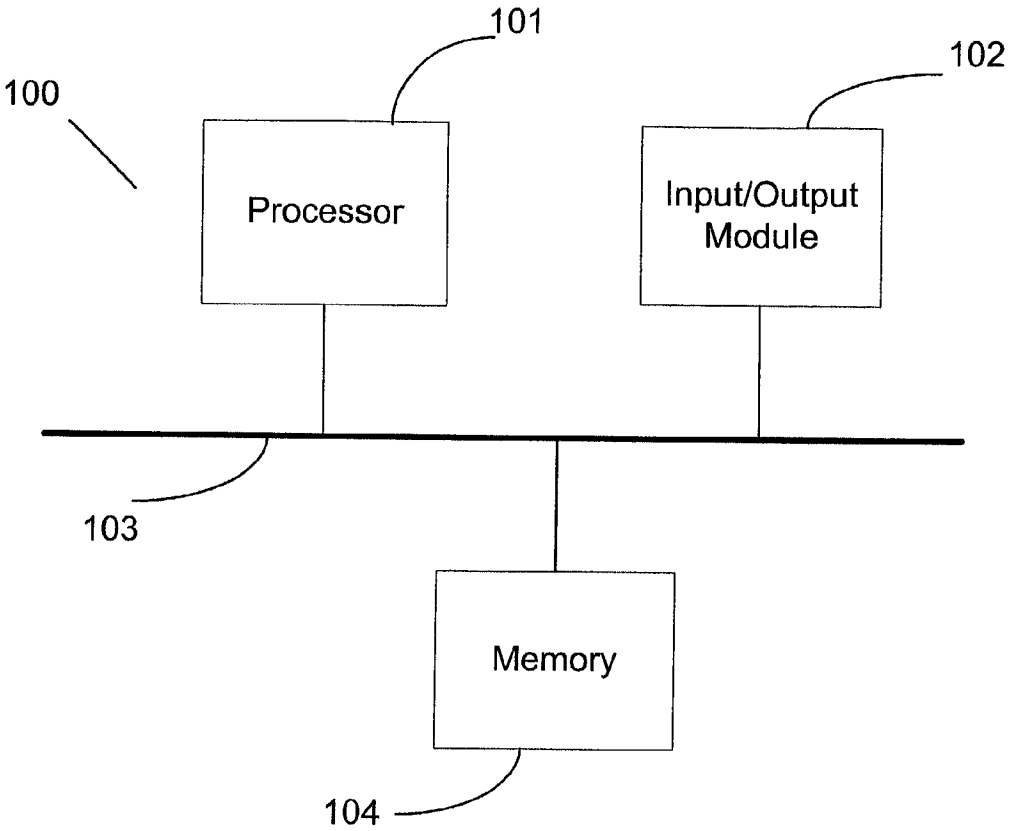
FIG. 5 is a block diagram of a computer system that can be used to implement one embodiment of the present invention.

FIG. 5 is a block diagram of a computer system 100 that can be used to implement one embodiment of the present invention. Computer system 100 includes a processor 101, an input/output module 102, and a memory 104. In one embodiment, the functionality described above is stored as software on memory 104 and executed by processor 101. Input/output module 102 in one embodiment receives input 58 of FIG. 3 and outputs output 59 of FIG. 3. Processor 101 can be any type of general or specific purpose processor. Memory 104 can be any type of computer readable medium.

As described, one embodiment of the present invention is a normalizer that accomplishes time domain transformation of digital audio signals while preventing noticeable audible artifacts from being introduced. Embodiments use a perceptual model of the human auditory system to accomplish the transformations.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A method of normalizing received digital audio data comprising:

decomposing the digital audio data into a plurality of sub-bands, applying a psycho-acoustic model to the digital audio data to generate a plurality of masking thresholds wherein the psycho-acoustic model comprises an absolute threshold of hearing;

generating a plurality of transformation adjustment parameters based on the masking thresholds and desired transformation parameters; and applying the transformation adjustment parameters to the sub-bands to generate transformed sub-bands, wherein the plurality of transformation adjustment are generated by providing a Sub-band Dominancy Meric.

2. The method of claim 1, wherein each plurality of sub-bands correspond to a critical band of a plurality of critical bands of the psycho-acoustic model, and wherein the masking thresholds are a function of the plurality of critical bands.

3. The method of claim 1, further comprising:

synthesizing the transformed sub-bands to generate a normalized digital audio data.

4. The method of claim 1, wherein said received digital audio data comprises a plurality of digital blocks.

5. The method of claim 1, wherein the digital audio data is decomposed based on a Wavelet Packet Tree.

6. A normalizer comprising:

a sub-band analysis module that decomposes received digital audio into a plurality of sub-bands, a psycho-acoustic model module that applies a psycho-acoustic model to the received digital audio data to generate a plurality of masking thresholds wherein the psycho-acoustic model comprises an absolute threshold of hearing;

a transformation parameter generation module that generates a plurality of transformation adjustment parameters based on the masking thresholds and desired transformation parameters; and a plurality of sub-band transform modules that apply the transformation adjustment parameters to the sub-bands to generate transformed sub-bands, wherein the plurality of transformation adjustment are generated by providing a Sub-band Dominancy Metric.

7. The normalizer of claim 6, wherein each of the plurality of sub-bands correspond to a critical band of a plurality of critical bands of the psycho-acoustic model, and wherein the masking thresholds are a function of the plurality of critical bands.

8. The normalizer of claim 6, further comprising:

a sub-band synthesis module that synthesizes the transformed sub-bands to generate a normalized digital audio data.

9. The normalizer of claim 6, wherein said receiver digital audio data comprises a plurality of digital blocks.

10. The normalizer of claim 6, wherein the digital audio data is decomposed based on a Wavelet Packet Tree.

11. A computer readable medium having instructions stored thereon that, when executed by a processor, cause the processor to:

decompose received digital audio data into a plurality of sub-bands, apply a psycho-acoustic model to the digital audio data generate a plurality of masking thresholds wherein the psycho-acoustic model comprises an absolute threshold of hearing;

generate a plurality of transformation adjustment parameters based on the masking thresholds and desired transformation parameters; and apply the transformation adjustment parameters to the sub-bands to generate transformed sub-bands, wherein the plurality of transformation adjustment are generated by providing a Sub-band Dominancy Metric.

12. The computer readable medium if claim 11, wherein each of the plurality of sub-bands correspond to a critical band of a plurality of critical bands of the psycho-acoustic model, and wherein the masking thresholds are a function of the plurality of critical bands.

13. The computer readable medium of claim 11, said instructions further causing the processor to:

synthesize the transformed sub-bands to generate a normalized digital audio data.

14. The computer readable medium of claim 11, wherein said received digital audio data comprises a plurality of digital blocks.

15. The computer readable medium of claim 11, wherein the digital audio data is decomposed based on a Wavelet Packet Tree.

16. A computer system comprising:

a bus;

a processor coupled to said bus; and a memory coupled to said bus;

wherein said memory stores instructions that, when executed by said processor, cause said processor to:

decompose received digital audio data into a plurality of sub-bands, apply a psycho-acoustic model to the digital audio data to generate a plurality of masking thresholds wherein the psycho-acoustic model comprises an absolute threshold of hearing;

generate a plurality of transformation adjustment parameters based on the masking thresholds and desired transformation parameters; and apply the transformation adjustment parameters to the sub-bands to generate transformed sub-bands, wherein the plurality of transformation adjustment are generated by providing a Sub-band Dominancy Metric.

17. The computer system of claim 16, wherein each of the plurality of sub-bands correspond to a critical band of plurality of critical bands of the psycho-acoustic model, and wherein the masking of thresholds are a function of the plurality of critical bands.

18. The computer system of claim 16, further comprising:

an input/output module coupled to said bus.

* * * * *

UNITED STATES PATENT AND TRADEMARK OFFICE

CERTIFICATE OF CORRECTION

PATENT NO. : 7,050,965 B2
APPLICATION NO. : 10/158908
DATED : May 23, 2006
INVENTOR(S) : Lopez-Estrada It is certified that error appears in the above-identified patent and that said Letters Patent is hereby corrected as shown below:

In column 3, at line 41, delete

"$T(SPL) = 3.64f^{-0.8} - 6.5e^{[-0.6(f-33)^2]} + 0.001f^4$"

insert -- $T(SPL) = 3.64f^{-0.8} - 6.5e^{[-0.6(f-3.3)^2]} + 0.001f^4$ --.

In column 3, at line 59, delete "$T(b) = \frac{1}{N_b} \sum_{\omega=\omega_l}^{\omega_h} 10^{\frac{T(SPL)}{10}}$" insert -- $T(b) = \frac{1}{N_b} \sum_{\omega=\omega_;}^{\omega_h} 10^{\frac{T(SPL)}{10}}$ --.

In column 6, at line 38, after "Dominancy" delete "Meric" insert --Metric--.

In column 6, at line 39, after "each" insert --of the--.

In column 6, at line 53, after "audio" insert --data--.

In column 7, at line 10, after "said" delete "receiver" insert --received--.

In column 7, at line 19, after "data" insert --to--.

In column 7, at line 30, after "medium" delete "if" insert --of--.

In column 8, at line 29, after second occurrence "of" insert --a--.

UNITED STATES PATENT AND TRADEMARK OFFICE

CERTIFICATE OF CORRECTION

PATENT NO. : 7,050,965 B2
APPLICATION NO. : 10/158908
DATED : May 23, 2006
INVENTOR(S) : Lopez-Estrada It is certified that error appears in the above-identified patent and that said Letters Patent is hereby corrected as shown below:

In column 8, at line 31, after “masking” delete first occurrence “of”.

Signed and Sealed this

Third Day of July, 2007

JON W. DUDAS
*Director of the United States Patent and Trademark Office*